United States Patent [19]

Burton

[11] 4,422,452

[45] Dec. 27, 1983

[54] GRAVITY TRACTION VEST

[75] Inventor: Charles V. Burton, Excelsior, Minn.

[73] Assignee: Abbott-Northwestern Hospital, Inc., Minneapolis, Minn.

[21] Appl. No.: 299,679

[22] Filed: Sep. 8, 1981

[51] Int. Cl.[3] ..... A61H 1/02

[52] U.S. Cl. ..... 128/75; 128/78

[58] Field of Search ..... 128/78, 84 C, 84 R, 128/73–75, DIG. 15, 68–70, 92 A, 106; 604/401, 402

[56] References Cited

U.S. PATENT DOCUMENTS

| | | | |
|---|---|---|---|
| 309,678 | 12/1884 | Aubin | 128/57 |
| 1,116,773 | 11/1914 | West et al. | 128/78 |
| 2,287,863 | 6/1942 | Buckley | 33/213 |
| 2,546,425 | 3/1951 | Broeker | 254/126 |
| 2,774,349 | 12/1956 | Judovich | 128/71 |
| 3,160,143 | 12/1964 | Gray | 119/96 |
| 3,167,068 | 1/1965 | Carr | 128/75 |
| 3,171,409 | 3/1965 | Cetrone | 128/106 |
| 3,589,358 | 6/1971 | Megal | 128/71 |
| 3,685,511 | 8/1972 | Alvarez | 128/57 |
| 3,786,803 | 1/1974 | Petulla et al. | 128/75 |
| 3,806,109 | 4/1974 | Weber et al. | 269/323 |
| 3,872,860 | 3/1975 | Noblitt | 128/75 |
| 4,178,922 | 12/1979 | Curlee | 128/78 |
| 4,205,665 | 6/1980 | Burton | 128/68 |
| 4,269,179 | 5/1981 | Burton et al. | 128/75 |

FOREIGN PATENT DOCUMENTS

| | | | |
|---|---|---|---|
| 318322 | 2/1957 | Switzerland | 128/75 |
| 883964 | 12/1961 | United Kingdom | 128/57 |

*Primary Examiner*—Henry J. Recla
*Assistant Examiner*—Karin M. Reichle
*Attorney, Agent, or Firm*—Merchant & Gould

[57] ABSTRACT

A vest (48) and vest insert (78) are the subjects of this patent application. The vest (48) is for use in a GRAVITY LUMBAR REDUCTION THERAPY PROGRAM apparatus, and the insert (78) extends along the bottom edge (56) of the vest (48) to engage the bottom surface (80) of a patient's lowermost rib (82) to support the patient (16) during treatment.

6 Claims, 4 Drawing Figures

GRAVITY TRACTION VEST

TECHNICAL FIELD

The invention of this application refers broadly to structures for therapeutically treating patients suffering from back illnesses such as improperly aligned or displaced vertebral elements. More specifically, however, the invention is directed to a support harness by which a patient can be supported at his rib cage when being treated using the GRAVITY LUMBAR REDUCTION THERAPY PROGRAM (GLRTP), the method of which is claimed by U.S. Pat. No. 4,205,665 issued to the Applicant of this present application on June 3, 1980.

BACKGROUND OF THE INVENTION

Back pain is a common and significant malady afflicting large numbers of people in virtually every country of the world. The widespread nature of the problem has been highlighted by numerous articles printed in both medical and news periodicals. Illustrative are an article entitled Bare-Bone Facts About Your Aching Back from the December, 1980 issue of Reader's Digest and the cover story from the July 14, 1980 issue of Time magazine.

Axial traction can be effective to alleviate certain types of back ailments. Such traction has been found to be an effective means of reducing improperly aligned or displaced vertebral elements as well as their associated intervertebral disks and soft tissues. Certain circumstances have, however, long presented obstacles to the effective application of controlled traction to the lumbar area. These circumstances include the significant amount of force which must be applied and the lack of a location at which the axiallly directed force can be applied.

In 1971, the Applicant supervised the construction of an apparatus to support a patient, having one of a number of conditions such as a protruded lumbar disk, in a vertical position wherein the torso of the patient was depended by a chest harness encircling the rib cage. As a result of research, the Applicant concluded that the rib cage could serve as an optimum site of fixation. He determined that, in order for the harness to function most effectively, it must, at its lower end, tighten beneath the rib cage so that, as axial force is applied to the harness, the rib cage will not slide therethrough.

The imposition of such a requirement presents certain problems to the provision of a harness which is both effective and comfortable to the patient being treated. Earliest prototypes of the harness included a series of cinctures which were spaced axially along the harness. Each of the cinctures was tightened about the rib cage of the patient with the lowermost being tightened below the rib cage in order to exert axial force thereon. Tightening of the lowermost belt to a point within the perimeter defined by the rib cage was accomplished exclusively by providing a belt having a sufficient number of locking points whereby the belt could be tightened so that it was within the perimeter of the rib cage regardless of the size of the patient being treated. Even though padding material was provided on the inside of the harness, such a structure frequently caused discomfort to the patient.

It is to these problems in the prior art that the structure of the present application is directed. It provides means whereby axial fixation can be efficiently accomplished, yet wherein the treatment is not rendered uncomfortable.

SUMMARY OF THE INVENTION

The invention of this application is a gravity traction vest and an insert carried by a vest by which a patient is supported when being treated by GRAVITY LUMBAR REDUCTION THERAPY treatment. The vest is secured about the torso of the patient being treated, with an inner surface thereof engaging a portion of the patient's rib cage and a portion of the torso just below the rib cage. The insert is flexible and cushiony in nature and protrudes from the inner surface of the vest proximate the lower edge thereof so that, as the vest is secured about the torso of the patient, the insert extends circumferentially about the patient. When the vest is attached as described above, the insert will protrude inwardly toward the patient and below the lowermost rib of the rib cage. As the patient is tilted from a reclining position to a more vertical position, the insert will exert axial force upon the lower surface of at least one of the lowermost ribs and cause the patient to be suspended by the vest.

Because of the structure of the rib cage, the vest can include a pair of inserts provided at portions of the vest wherein, when the vest is attached to the torso of the patient, the insert will abut the patient at a side, engaging the bottom surface of each of the patient's lowermost ribs. In a preferred embodiment, the insert can have an inwardly facing, normally convex arcuate surface which faces inwardly toward the patient. The insert can, thus, be made so that it is essentially D-shaped in transverse cross-section. Such a structure maximizes the ability of the insert to cause the vest to support a patient in an oblique or vertical orientation while, concurrently, minimizing discomfort to the patient.

The invention of this application is, therefore, an insert for use with a gravity traction vest and an improved vest of this type. More specific advantages of the invention will become apparent with reference to the accompanying Detailed Description, Drawings, and Claims.

DETAILED DESCRIPTION OF THE INVENTION

Figure 1:
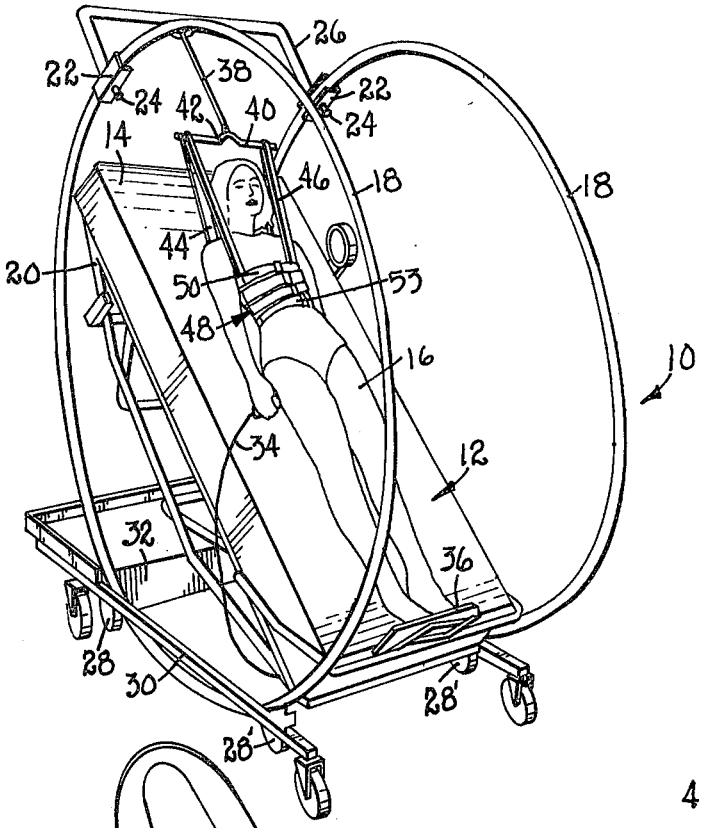
FIG. 1 is a view in perspective of a gravity lumbar reduction therapy apparatus utilizing a gravity traction vest of the type of the present invention.

Referring now to the drawings wherein like reference numerals denote like elements throughout the several views, FIG. 1 shows a gravity lumbar reduction apparatus 10 with which the invention of the present application is used. The apparatus 10 includes a bed 12 which forms a support surface 14 upon which the patient 16 rests and which provides a measure of support to the patient 16 when the patient 16 is oriented either horizontally or obliquely. The bed 12 is mounted between two circular hoops 18 which are fixed to the bed frame 20 at or near the corners thereof.

Each loop 18 has a location about the periphery thereof at which channels 22, which include spring loaded pins 24 or other locking means, can be affixed. The pins 24 can be made to register with holes (not shown) formed in the hoops 18. The channels 22, jointly, carry a traction bar 26. The location of the traction bar 26 with respect to a plane defined by the bed support surface 14 can, thereby, be varied.

The hoops 18 rest on rollers 28, 28' rotatably mounted to a cradle 30. The drive rollers 28, only one of which is shown, are driven by a drive motor 32. Manual control means 34 can be provided to control direction and speed of the motor 32. The motor 32 causes rotation of the drive rollers 28 which, in turn, effect rotation of the hoops 18. By use of the control means 34, the patient 16 positioned on the bed 12 can selectively rotate the bed 12 to any angle of tilt.

The bed 12 can include an adjustable foot stop 36 located proximate the foot of the bed 12. The foot stop 36 can serve as a safety device to limit the distance a patient would fall if the patient support structure, which includes the traction bar 26, failed.

A cable 38 depends from the traction bar 26. At an end of the cable 38 opposite that by which it is affixed to the traction bar 26, a spreader bar 40 is attached. The spreader bar 40 includes a bend 42 formed centrally therein. This bend 42 is the point at which the cable 38 secures the spreader bar 40.

A pair of straps 44, 46 are secured to the spreader bar 40 at opposite ends thereof. Appropriate means such as detents (not shown) can be utilized to prevent sliding of the straps 44, 46 across the spreader bar 40.

A vest 48 is secured to the thorax of the patient 16. This is accomplished by using a plurality of cinctures or belts 50–53 which can form part of the vest 48 and, when the vest 48 is wrapped around the patient's thorax, extend circumferentially around the patient 16.

The straps 44, 46 are, at their free ends, attached to the vest 48 and can be formed integrally therewith. Preferably, the straps 44, 46, themselves, are of one piece construction.

Figure 2:
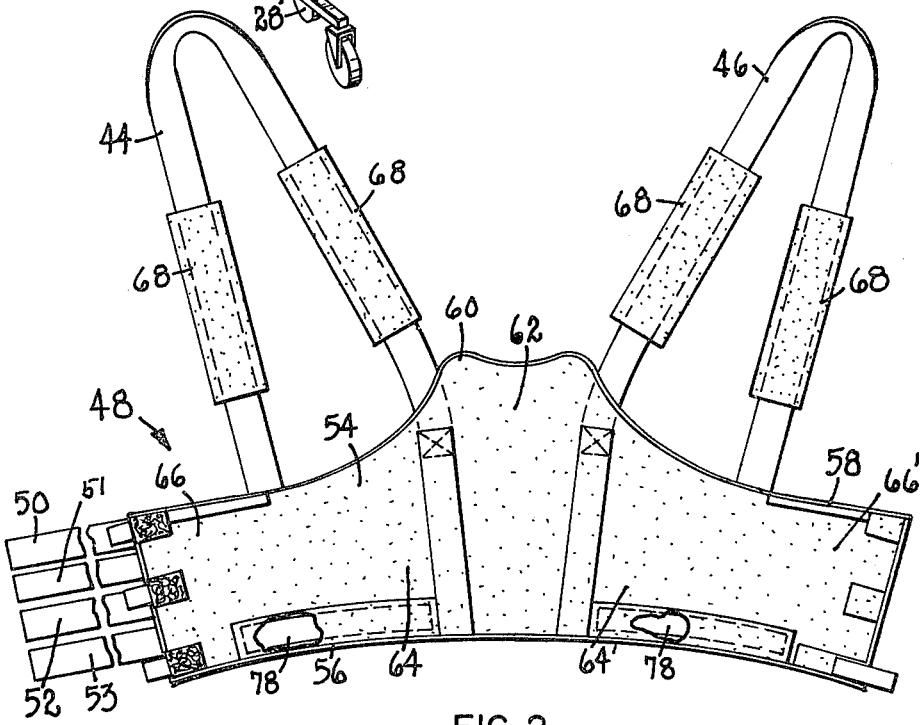
FIG. 2 is a view illustrating the inside of the gravity traction vest, some portions thereof broken away.
Figure 3:
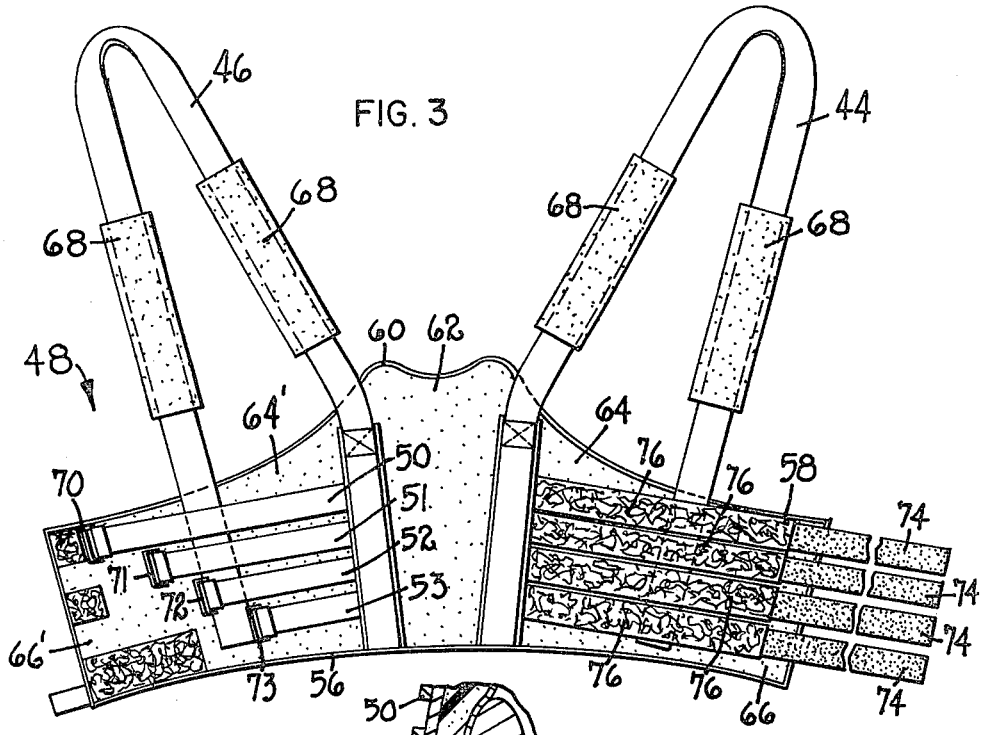
FIG. 3 is a view illustrating the outside of the gravity traction vest.

Referring now to FIGS. 2 and 3, details of the vest 48 are illustrated. The vest 48 is structured so that, when it is girdled about the torso of the patient 16, an inner surface 54 abuts the patient's thorax. Although not essential to the invention, a lower edge 56 of this inner surface 54 extends substantially linearly when the vest 48 is flattened, while an upper edge 58 is irregular as at 60 and extends upwardly along the back of the patient 16 to which the vest 48 is attached.

This irregular upwardly extending edge 58 defines a back portion 62 of the vest 48 designed to be positioned proximate, and to extend along, the back of the patient 16, when the vest 48 is attached. A pair of lateral portions 64, 64' are defined by that part of the vest 48 which extends between the front and back attachment points of the support straps 44, 46. Forwardly from these lateral portions 64, 64' are a pair of overlappable front portions 66, 66'. These front portions 66, 66' can, in certain embodiments, have velcro attachment means to close the vest 48 onto the torso of the patient 16.

Cushion elements 68 can be attached to each of the straps 44, 46 and to both front and back portions thereof. These elements 68 serve to minimize abrasive discomfort which might result from the straps 44, 46 moving across the skin of the patient 16.

Each of the cinctures 50–53 carries, at one end thereof, a metal loop 70–73 through which the opposite end can be fed. The cincture is, thereafter, folded back upon itself and attached to itself by any appropriate means. Typically, one side of the free end of the cincture can carry velcro pile material as at 74, and the side of the cincture against which the free end abuts can carry velcro hook material as at 76.

Figure 4:
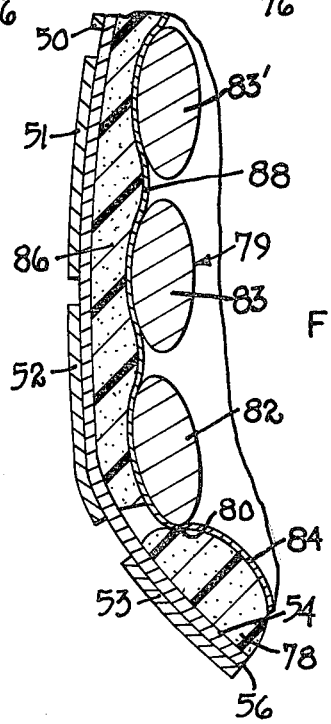
FIG. 4 is an enlarged fragmentary view in cross-section illustrating a portion of the vest when attached to the torso of a patient being treated.

Referring now to FIG. 4, the inner surface 54 of the vest 48 carries, proximate the lower edge 56 thereof, a flexible cushion insert 78. This insert 78 protrudes inwardly toward the patient to which the vest 48 is affixed. The vest 48 can be manufactured so that the insert 78 protrudes from the inner surface 54 directly opposite the lowermost 53 of the cinctures. Consequently, when the cinctures 50–53 are tightened to secure the vest 48 tightly to the patient with the lowermost cincture 53 just below the rib cage 79 which includes ribs 82, 83, 83', the insert 78 will be forced to protrude inwardly into the body of the patient 16 below the lowermost rib 82 while the portion of vest 48 encircled by the cinctures 50–52 girdles the ribs 82, 83 and 83'. The insert 78 can, thereby, serve as a platform upon which the bottom surface 80 of the lowermost rib 82 can rest when the patient is tilted toward a generally vertical position.

The insert 78 can include a generally convex arcuate surface 84 which faces inwardly toward the torso of the patient 16. In one embodiment, the insert can be D-shaped in cross-section. By so structuring the insert 78, adequate support of the patient 16 can be accomplished while minimizing discomfort.

Means can be provided for further minimizing the discomfort to the patient 16. Padding 86 can be attached on the inside surface 54 of the vest 48 opposite the other cinctures 50–52. Although not serving a primary supporting function, this padding 86 will make it easier for the patient 16 to endure longer periods of treatment. Additionally, both the insert 78 and the padding 86 can be covered with a sheet of material 88 which directly engages the patient's body. The material 88 can be of a nature to impede slipping.

Because of the symmetry of the rib cage 79, it is desirable to provide a pair of flexible cushion inserts 78, one of the pair attached proximate the lower edge 56 of the vest 48 and to one of the lateral portions thereof. By utilizing such a pair of inserts, the patient's body can be supported so that it is not canted to one side or another.

Numerous characteristics and advantages of the invention have been set forth in the foregoing description. It will be understood, of course, that the appropriate scope of the invention is defined in the appended claims. Consequently, the invention is not to be limited by any specific language herein used to describe preferred embodiments or alternative structures.

What is claimed is:

1. A gravity traction vest for secure attachment to a patient, the patient having a torso with a rib cage having a plurality of ribs including a lowest rib, said vest adapted to be secured to the patient and attached to a support structure whereby the patient is suspended from the support structure with the head of the patient in an upward direction, said vest comprising:

(a) a torso surrounding member having upper and lower edges and inner and outer surfaces for encircling the torso and rib cage of the patient;

(b) support means cooperatively connected to said member and adapted to be attached to the support structure for suspending said member from the support structure and applying a uniform force on said member in said upward direction;

(c) attachment means for securing said member to the patient; and (d) a flexible cushion insert means extending along at least a portion of said lower edge of said inner surface of said member and protruding inwardly toward the patient for engagement below the lowest rib, wherein when said vest is attached about the patient's rib cage, substantially said entire insert means is positioned below the lowest rib and said insert means is urged inwardly toward the patient to a position wherein said insert means will restrain movement of said member caused by said force applied by said support means.

2. The vest of claim 1 wherein the vest attachment means includes a plurality of cinctures extending about the torso surrounding member when said vest is secured to the patient, and wherein said insert means protrudes from the inner surface of the vest immediately opposite the lowermost of said cinctures, wherein, when said lowermost cincture is tightened with the vest positioned along the patient's torso so that said insert means is immediately below the bottom surface of the patient's lowermost rib.

3. The vest of claim 2 wherein the torso surrounding member includes a back portion, a pair of lateral portions, and a pair of overlappable front portions, and wherein the cushion insert means extends along the lower edge of the inner surface of each of the lateral portions of said torso surrounding member and protrudes inwardly therefrom.

4. The vest of claim 3 wherein said insert means includes an inwardly facing, normally convex arcuate surface.

5. The vest of claim 3 wherein said insert means is D-shaped in transverse cross-section.

6. A method of suspending a patient being treated by gravity lumbar reduction therapy, said method including the steps of encircling the rib cage and a portion of the torso therebelow of the patient, with a vest having a cushion insert extending inwardly toward the patient from a lower edge of the vest and having a cincture over the insert and positioning the vest along the patient's torso so that substantially the entire insert is disposed immediately below the lowermost rib of the patient and engages a bottom surface of the rib, securing the vest about the rib cage by tightening the cincture over the insert, suspensing the patient from a support structure with the head of the patient in an upward direction by suspensing the vest from the support structure wherein upward movement of the vest relative to the torso of the patient is restrained by said insert.

* * * * *